US007168601B2

(12) United States Patent
Goodhue

(10) Patent No.: US 7,168,601 B2
(45) Date of Patent: Jan. 30, 2007

(54) PACKAGING DEVICE FOR FASTENERS

(75) Inventor: William V. Goodhue, North Kingstown, RI (US)

(73) Assignee: Systemation, Inc., Warwick, RI (US)

( * ) Notice: Subject to any disclaimer, the term of this patent is extended or adjusted under 35 U.S.C. 154(b) by 188 days.

(21) Appl. No.: 10/601,667

(22) Filed: Jun. 24, 2003

(65) Prior Publication Data

US 2005/0173480 A1 Aug. 11, 2005

Related U.S. Application Data

(62) Division of application No. 09/929,085, filed on Aug. 15, 2001, now Pat. No. 6,612,470.

(51) Int. Cl.
*A44C 5/18* (2006.01)

(52) U.S. Cl. ..... 224/221; 224/222; 224/249; 224/681; 206/347

(58) Field of Classification Search ..... 224/219, 224/220, 221, 222, 249, 681, 270; 206/347, 206/383, 342, 338; 411/442, 443
See application file for complete search history.

(56) References Cited

U.S. PATENT DOCUMENTS 2,058,340 A * 10/1936 Miller ..... 223/109 R
2,689,645 A * 9/1954 Greene, Jr. ..... 206/338
2,714,449 A * 8/1955 Holland ..... 206/338
3,473,991 A * 10/1969 Ludwig ..... 156/290
4,325,504 A * 4/1982 Amani ..... 224/183
4,830,246 A * 5/1989 Ryan ..... 224/221
4,955,476 A * 9/1990 Nakata et al. ..... 206/346
5,221,032 A * 6/1993 Bott et al. ..... 224/270
5,333,767 A * 8/1994 Anderson ..... 224/183
5,437,368 A * 8/1995 Mikels ..... 206/341
5,443,345 A * 8/1995 Gupta ..... 411/441
5,520,119 A * 5/1996 Eisenberg ..... 108/43
5,593,073 A * 1/1997 Finnegan ..... 224/183
5,931,298 A * 8/1999 Huang ..... 206/346
5,964,385 A * 10/1999 Simon ..... 224/162
RE37,239 E * 6/2001 Eisenberg ..... 108/43
6,272,814 B1 * 8/2001 Ikuta et al. ..... 53/473
6,315,118 B1 * 11/2001 Sauce ..... 206/338
6,343,693 B1 * 2/2002 Finley ..... 206/338
6,374,719 B1 * 4/2002 Phillips ..... 89/34

* cited by examiner

*Primary Examiner*—Stephen K. Cronin
(74) *Attorney, Agent, or Firm*—Breiner & Breiner, L.L.C.

(57) ABSTRACT

An apparatus is provided for packaging fasteners such as screws, that is to be worn by a user. The packaging device includes a tray with a plurality of wells, each well accommodating the shank of a respective fastener. An attachment device is used for securing a tray to a user. In a preferred dispensing method, fasteners may be dispensed from the tray using a magnetized screwdriver bit which is placed over the head of the fastener, followed by withdrawing the screwdriver bit with the fastener magnetically attached.

48 Claims, 4 Drawing Sheets

54
16
14
56
20
12
50
40
32
48
46
36
30
41
48
45
18
43
34
10
42
38
52
14
36
16
32
40
46
24
41
45
18
62
24
43
60
10

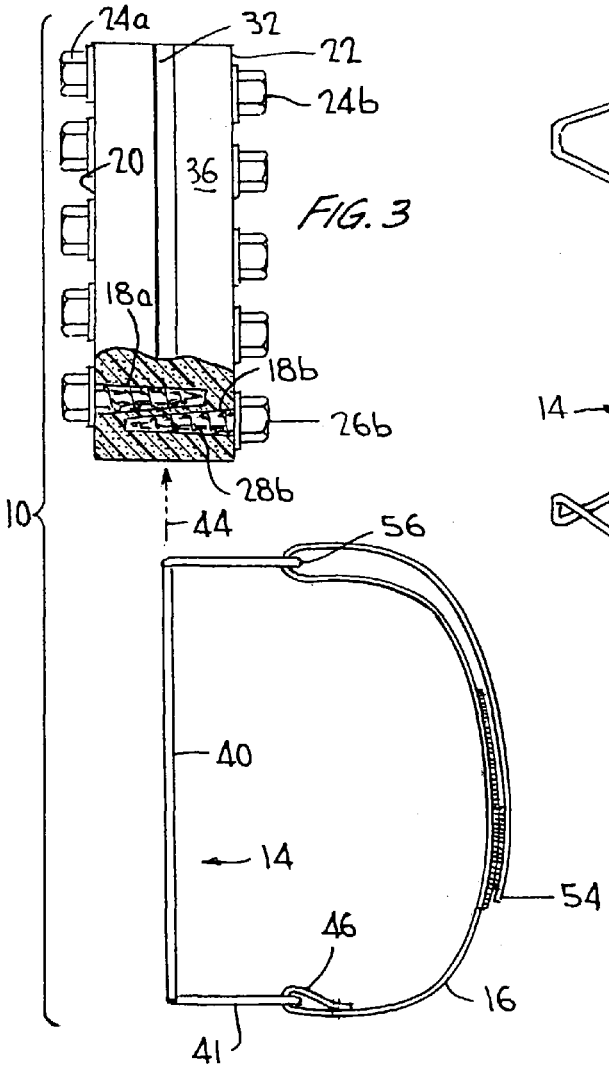
FIG. 3
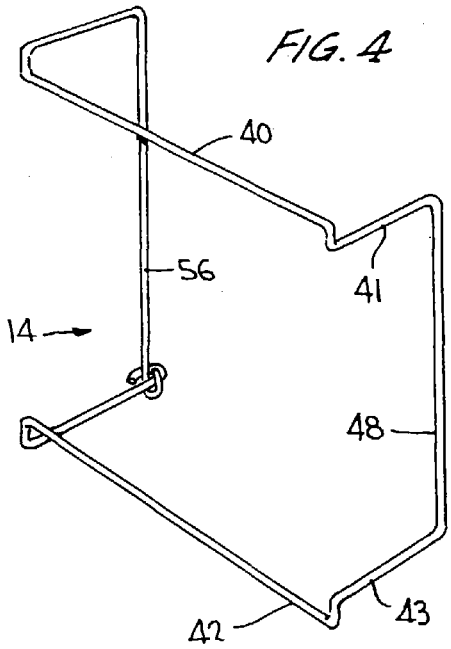
FIG. 4
FIG. 5
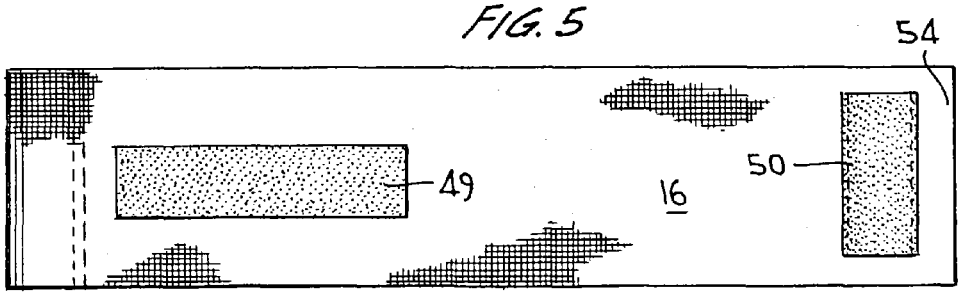
FIG. 6
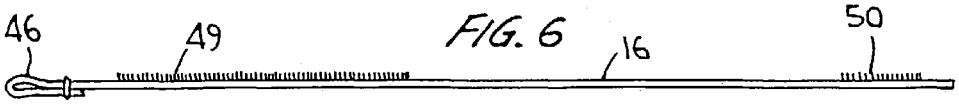

PACKAGING DEVICE FOR FASTENERS

BACKGROUND OF THE INVENTION

The present invention relates to a device for packaging fasteners, and in particular, to a device to be worn by a user for packaging and dispensing fasteners.

Steel metal ducts are used in the heating, ventilating, and air conditioning ("HVAC") industry. Adjacent sections of the metal ducts are typically connected to each other by hex-head, self-tapping screws with integral washers, e.g., "tech screws". In the HVAC industry, the task of connecting adjacent sections of a sheet metal duct normally occurs on lifts and in confined spaces.

A typical HVAC insulation will require an HVAC worker to insert anywhere from two to ten screws per duct joint. The conventional method used by the HVAC worker involves the use of a screwdriver or drill with a magnetic hex socket and an apron full of tech screws. The HVAC worker removes an individual tech screw from his apron and then, by hand, places the screw into the hex socket followed by screwing the tech screw through the sections of the sheet metal duct. This screw installation process is complicated by gloves which are traditionally worn by the HVAC worker. It is estimated that about 30% of the tech screws intended to be inserted into the sheet metal duct sections are dropped and/or lost by the HVAC worker as he or she attempts to hand place the tech screws into the hex socket.

One disadvantage with the present method of inserting a tech screw into adjacent sections of sheet metal duct is that the method is laborious, slow and costly. Accordingly, there is a need in the HVAC industry, and other similar industries, for a lightweight, portable system that will increase the productivity of workers and decrease the costs associated with the time consuming manual insertion of tech screws into the hex socket and the cost associated with lost screws.

Screw guns with feeding and locating fasteners for insertion into a workpiece are generally known in the art. However, the conventional designs are not practical for HVAC employment as these designs are overly complex and therefore costly. Further, these conventional screw guns tend to be bulky and not easy to use, especially when working in confined spaces such as those associated with HVAC installations.

For example, known power operated devices for feeding and locating fasteners, like those disclosed by U.S. Pat. No. 5,031,489 to Young et al. and U.S. Pat. No. 5,015,127 to Hockman, require that a fastener driver be connected to an air supply to power the device and to a hopper or the like in order to continuously feed the driver with fasteners. Such devices limit their application because of their lack of mobility and unwieldiness. Accordingly, such devices are not practical for use in confined spaces, such as when working on a scaffolding or a lift. Similar devices for feeding and locating fasteners have strips which carry the screws and are swingedly suspended from the device, such as disclosed in U.S. Pat. No. 3,910,324 to Nasiatka and U.S. Pat. No. 4,581,964 to Takatsuru. These devices are also not practical for use in confined spaces because of the added weight and awkwardness associated with the devices.

U.S. Pat. No. 4,936,169 to Parsons discloses a portable device for positioning and inserting fasteners wherein an applicator is positioned adjacent to a positioning mechanism containing a rotatable cylinder which includes a plurality of chambers for housing fasteners. However, the Parsons device has a number of drawbacks including that it is bulky, the operator is required to align a screw with the applicator by hand before he can insert a second screw into a workpiece, and the screw is not readily visible prior to insertion.

My copending application Ser. No. 09/877,036 filed Jun. 11, 2001 discloses an improved screw gun for inserting fasteners, including tech screws. The disclosed screw gun and method provides a substantial improvement over the prior art. However, if this device is not used, there remains a need in the industry for a device for carrying fasteners.

Additionally, the prior art also generally discloses various devices for holding screws on other objects including U.S. Pat. Nos. 2,012,615; 3,321,074; 3,342,327; 3,718,252; 3,885,669; 4,019,631; 4,027,417; 4,151,912; 4,930,630; 4,955,476; 5,509,728; 5,522,687; and 5,578,760. However, these devices have certain drawbacks and/or are not applicable to the present invention.

BRIEF SUMMARY OF THE INVENTION

In accordance with the present invention, a device is provided for packaging fasteners which is worn by a user. The device includes a plurality of holes in which fasteners such as screws may be disposed and is to be worn by a user such as on the user's wrist or attached to a belt worn by the user. The screws are dispensed from the device by a user placing a magnetized screwdriver bit e.g., a hex socket, on the head of the screw in the device and then removing the screw from the device. In the preferred embodiment, the screw is removed from the device by rotating the bit and pulling the screwdriver with the screw attached magnetically away from the device.

According to one aspect of the present invention, an apparatus is provided for packaging fasteners which is to be worn by a user. The apparatus includes a tray having a plurality of wells. Each well accommodates a shank of a respective fastener. The tray has a first side opposite a second side. An attachment device is provided for securing the tray to the user.

According to another aspect of the present invention, an apparatus is provided for packaging fasteners which may be worn by a user or located near the user. The apparatus includes a tray having a plurality of wells. Each well accommodates a shank of a respective fastener. The, tray has a first side opposite a second side, each side having a plurality of wells to provide an apparatus to package a number of fasteners. The apparatus is preferably a plastic molded shell. The shanks of the fasteners are inserted into the wells and there is clearance between the shanks and the wells. The fasteners are to be maintained in the apparatus by an adhesive on the surface of the tray which will adhere the head of the fastener (the washer portion in the case of a tech screw) to the tray. The fastener may be removed from the tray by placing the bit of a screwdriver over the head of the fastener and rotating the bit to break the adhesive seal and withdraw the fastener. An attachment device may be provided for securing the tray to the user, although the apparatus may be used without being secured to the user.

According to another aspect of the present invention, a system is provided for packaging fasteners. The system includes a plurality of fasteners, each fastener having a shank with a shank diameter. The system also includes a tray having a plurality of wells. Each well accommodates the shank of a respective fastener. The tray has a first side opposite a second side. An attachment device is provided for securing the tray to the user.

According to yet another aspect of the present invention, a method is provided for dispensing fasteners. The method comprises attaching a tray to a user in which the tray has a plurality of fasteners, each disposed in a respective one of a plurality of wells. A magnetized screwdriver bit is placed over the fastener. The screwdriver bit with a magnetically attached fastener is then withdrawn from the tray.

One feature of the present invention relates to a packaging device that is worn by a user for dispensing screws. Further, the packaging device allows a user to dispense, i.e., remove, individual screws from a tray by placing the bit, e.g., a hex socket, of a screwdriver on the head of the screw in the tray followed by withdrawing the screwdriver and attached screw from the tray. Consequently, an advantage of the present invention is provided by a user not having to manually insert a screw into the screwdriver bit by fishing one's hand into an apron full of screws and then hand placing, i.e., inserting, the screw into the screwdriver bit.

An additional advantage of the present system is a decrease in the costs associated with the installation of HVAC systems. The decrease in costs is provided by a decrease in installation time associated with a worker not having to manually hand place screws into a screwdriver bit, and the costs associated with not dropping and losing screws which typically occurs when manually hand placing screws into a screwdriver bit.

Further features and advantages of the present invention will be set forth in, or apparent from, the detailed description of preferred embodiments thereof which follows.

BRIEF DESCRIPTION OF THE SEVERAL VIEWS OF THE DRAWINGS

FIG. 3 is an exploded top view with a portion broken-away of the device of FIG. 1;

FIG. 4 is a front, side and top perspective view of a metal frame of the device of FIG. 1;

FIG. 5 is a plan view of a strap for attaching the packaging device to a user of the device of FIG. 1;

FIG. 6 is a side view of the strap of FIG. 5;

DETAILED DESCRIPTION OF THE INVENTION

Figures 1, 2:
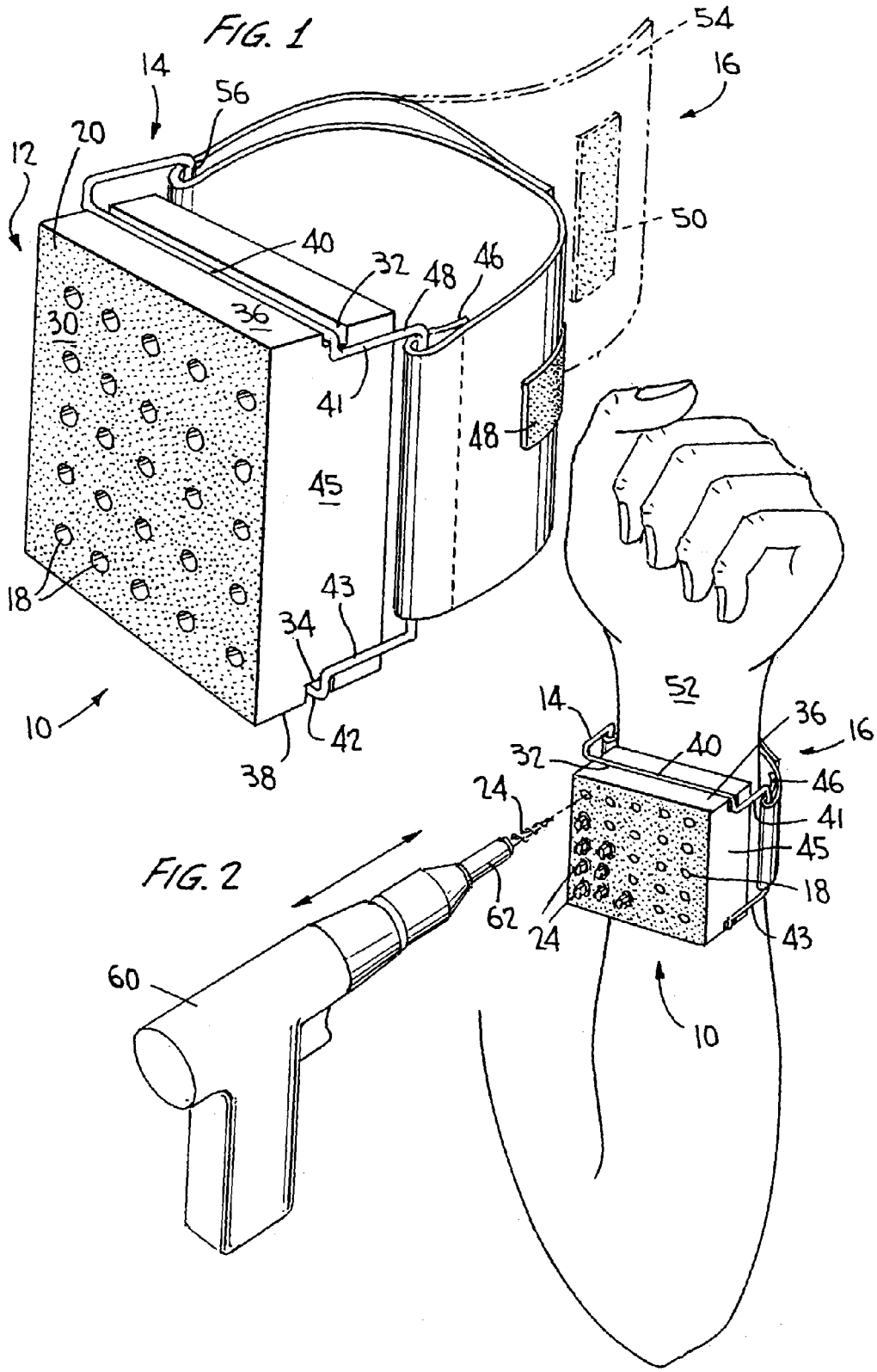
FIG. 1 is a front, side and top perspective view of a device for packaging fasteners that is to be worn by a user in accordance with the present invention.
FIG. 2 is a front, side and top perspective view of the packaging device of FIG. 1 attached to a wrist of the user schematically showing the removal of a fastener from the device using a drill with screwdriver bit.

Referring now to FIGS. 1–3, a fastener packaging device 10 includes a tray 12, a frame 14, and a strap 16. Tray 12 comprises a plurality of holes, i.e., wells 18*a*, formed in a side 20. Advantageously, a second plurality of wells 18*b* are formed in an opposing side 22, with wells 18*b* being offset from wells 18*a* in side 20 (best shown in FIG. 3).

Tray 12 may be composed of a number of suitable materials which include plastic and styrofoam. If tray 12 is composed of styrofoam, the plurality of wells 18*a*, 18*b* may be formed using a hot wire to provide smooth and stronger wells 18.

The plurality of wells 18*a*, 18*b* accommodate a plurality of fasteners such as hex screws 24*a*, 24*b*, respectively. Hex screws 24 have a hexagonal head 26 and a shank 28. The diameter of wells 18 may be dimensioned to be slightly larger than that of shank 28, equal to that of shank 28, or slightly smaller than that of shank 28. If the well diameter is slightly smaller than the diameter of shank 28, screw 24 will be held in place in tray 12 by a tight fitting relationship.

Alternatively, in a preferred arrangement, wells 18 are slightly larger than the diameter of the shank 28 so that hex screws 24 can be rapidly placed into tray 12. Advantageously, a coating of pressure sensitive adhesive material 30 is disposed on the surface of sides 20, 22 prior to insertion of screws 24 in wells 18. As a result, screws 24 will be held in tray 12 as a result of adhesive 30 which will dry after screws 24 are inserted. Screws 24 are held in tray 12 by an adhesive force sufficient to keep screws 24 in tray 12 yet allow screws 24 to be readily removed from tray 12 via extraction using a screwdriver with magnetic bit as discussed below.

Referring to FIGS. 1–3, along with FIG. 4, tray 12 includes two tracks 32, 34 on opposing side walls 36, 38, respectively. Frame 14 is composed of a suitable material such as metal and includes two opposing rails 40, 42 complimentary to tracks 32, 34, respectively, thereby allowing frame 14 to slidingly engage with tracks 32, 34 respectively as denoted by arrow 44 (FIG. 3). Rails 41, 43 disposed perpendicular to respective rails 40, 42 abut side 45 of tray 12 thereby preventing tray 12 from sliding therebeyond.

Referring now to FIGS. 5 and 6, along with FIGS. 2 and 4, strap 16 is attached to frame 14 by a loop 46 which encircles rail 48 extending between rails 41, 43. Strap 16 also includes complimentary Velcro strips, namely a piece of fabric of small hooks 49 and a corresponding fabric of small loops 50. Strap 16 provides means to removeably attach fastener packaging device 10 to a user such as at a wrist 52. To accomplish this, a strap end 54 is wrapped around wrist 52 and threaded around rail 56 which extends parallel to rail 48. Strap end 54 is pulled so that fastener packing device 10 fits securely to wrist 52 and Velcro strips 49, 50 are the mated with one another to hold tray 12 in place.

Referring now specifically to FIGS. 2 and 3, screws 24 are dispensed from tray 12 using a drill 60 with a magnetic bit 62 which has a socket shape to accommodate and subsequently drive hexagonal head 26. The user places screwdriver bit 62 on one head 26, and then with a slight turning action of screwdriver bit 62, screw 24 is withdrawn from tray 12. Depending on how tight the fit is between well 18 and shank 28 of screw 24 as well as the strength of adhesive 30, it may not be necessary to use a slight turning action to remove screw 24 from well 18. After all of screws 18*a* have been removed from tray 12, the user can slide tray 12 from frame 14 in a direction opposite to arrow 44 (FIG. 3). The user then rotates tray 12 such that side 22 faces away from wrist 52, and slides tray, 12 back on frame 14 with the plurality of screws 18*b* now accessible for insertion into screwdriver bit 62.

Figure 7:
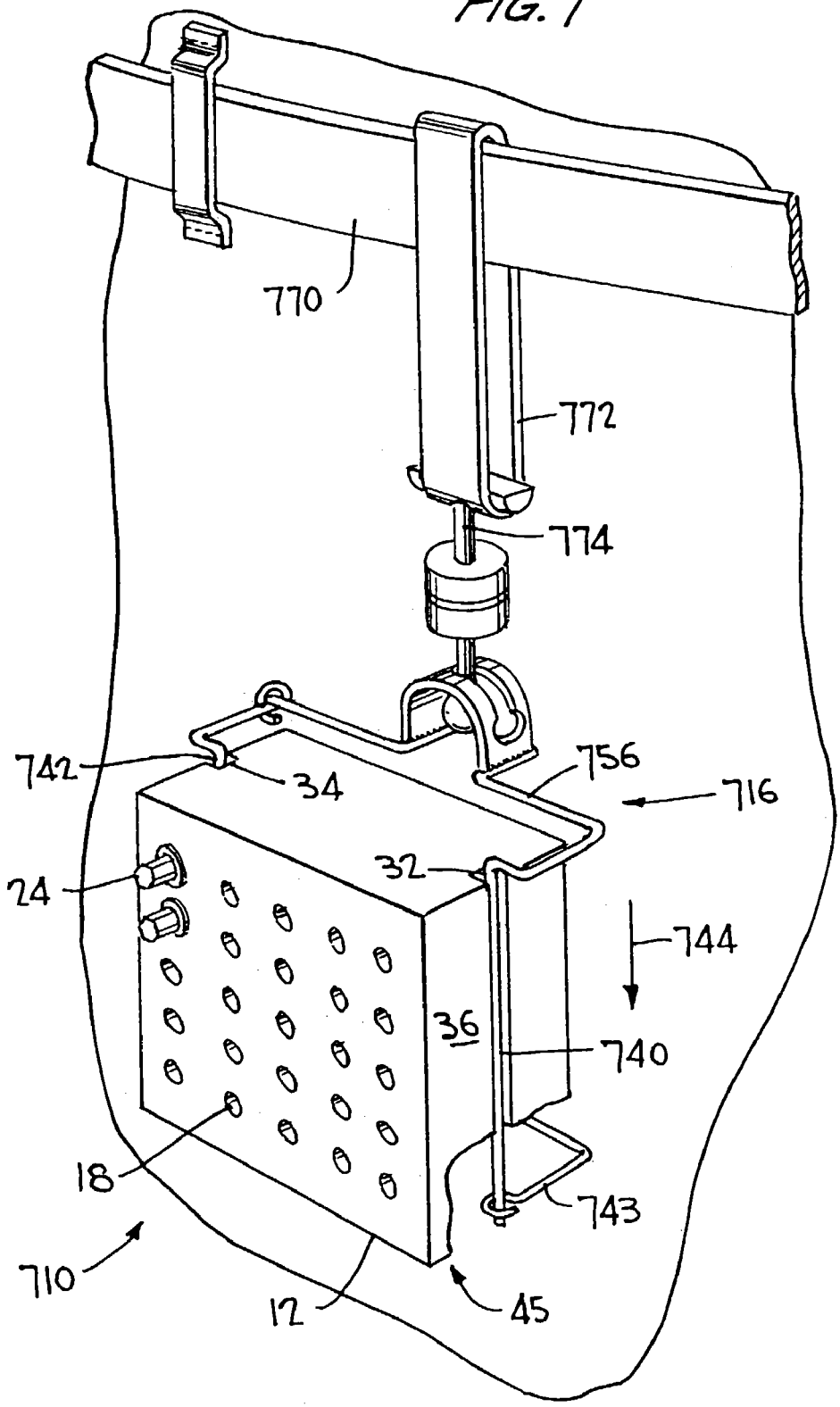
FIG. 7 is a front, side and top perspective view with a portion broken-away of an alternative packing device, according to the present invention.

Referring now to FIG. 7, in an alternative embodiment; rather than attaching the fastener packaging device to the wrist of a user, a fastener packing device 710 is attached to a belt 770 worn by a user. A frame 716 includes opposing rails 740, 742 which are adapted to slidingly engage with the complementary tracks 32, 34 respectively, of tray 12. Rails 743 and an opposite rail (not shown) abut the surface of side 45 of tray 12 to prevent tray 12 from sliding there past. A strap 772 is looped around belt 770 and wrapped around an end of a shaft 774 pivotally engaged with frame 716 for free movement therewith. Strap 772 thus provides means for attaching packaging device 710 to the user.

Figure 8A:
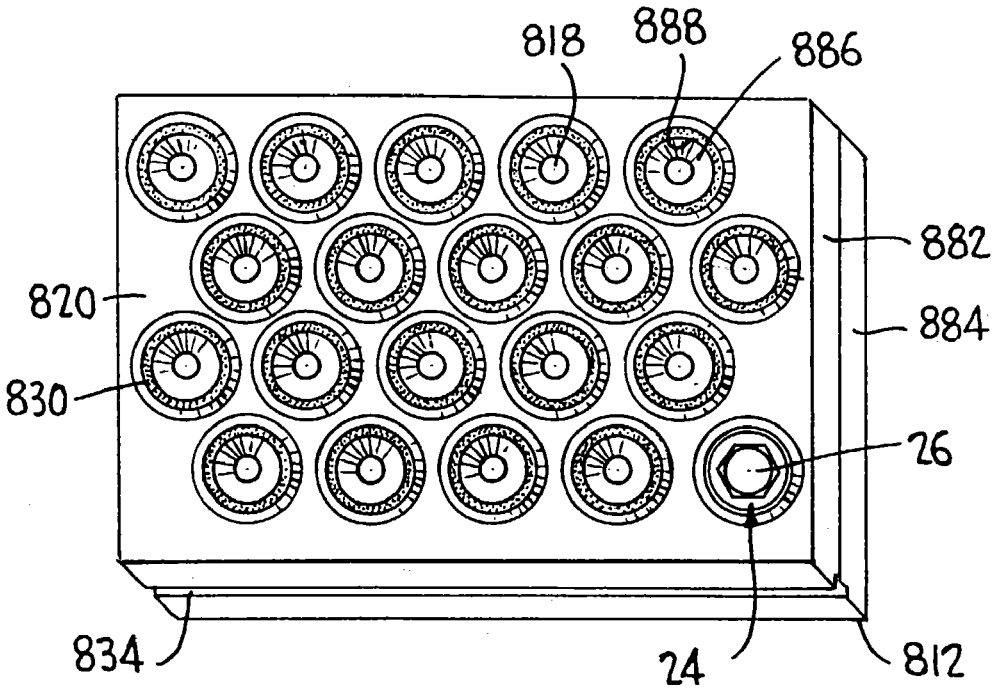
FIG. 8*a* is a front, side and bottom perspective view of a plastic tray
Figure 8B:
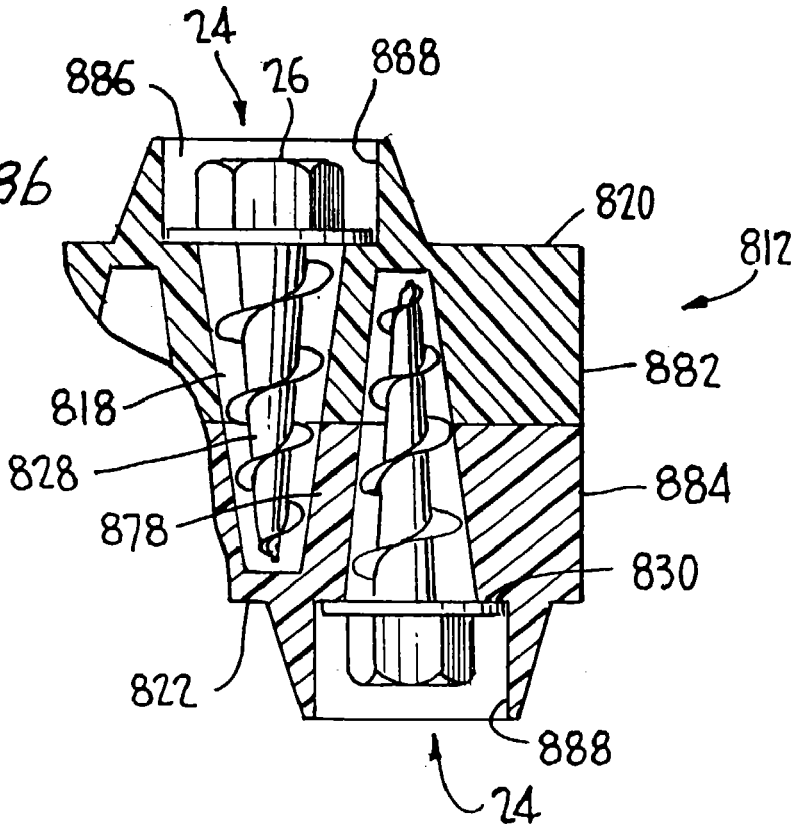
FIG. 8*b* is a cross-sectional view with a portion broken-away of the plastic tray of FIG. 8*a*.

In an alternative embodiment, rather than a styrofoam tray such as tray 12, tray 812 is formed from two thin plastic shells, 882, 884, joined with one another (FIGS. 8*a* and 8*b*). An internal plastic web 878 formed from shells 882, 884, defines wells 818. Wells 818 accommodate shafts 828 of screws 824.

A plurality of bores 886 with sidewall surfaces 888, respectively, are formed in side surfaces 820, 822. Each bore 886 leads to, and is associated with, the entrance of a respective well 818. The diameter of bores 886, is larger than the diameter of wells 818 and is sufficient to accommodate the diameter of heads 26 of screws 24. Sidewall surfaces 888 of bores 886 help guide screwdriver bit 62 (FIG. 2) into place over heads 26 of screws 24, during the extraction of screws 24 from tray 812 using the extraction method described above with reference to tray 12.

A pressure sensitive adhesive 830 is applied to the surface of tray 812 at the base of bores 886 which surrounds wells 818. When screws 24 are inserted into tray 812, adhesive 830 will come in contact with heads 26 of screws 24, thereby holding screws 24 in tray 812.

Tray 812 may be used alone or attached to the user by means as shown in FIGS. 1–7 and described above.

Although the invention has been described above in relation to preferred embodiments thereof, it will be understood by those skilled in the art that variations and modifications can be effected in these preferred embodiments without departing from the scope and spirit of the invention.

What is claimed is:

1. An apparatus for packaging fasteners to be worn by a user, said apparatus comprising:

a tray having a plurality of wells, each said well being sized to accommodate a shank of a respective fastener therein; and an attachment device which secures the tray to the user, wherein said tray is formed from styrofoam.

2. A system for packaging fasteners, said system comprising:

a plurality of fasteners each having shank with a shank diameter;

a tray having a plurality of wells, each said well being sized to accommodate the shank of a respective fastener therein; and an attachment device which secures the tray to the user.

3. The system of claim 2, wherein said tray is formed from material comprising styrofoam.

4. The system of claim 2, wherein said plurality of wells comprises a first set of said wells in a first side of said tray and a second set of said wells in a second side opposite to said first side.

5. The system of claim 4, wherein said first set of said wells is offset longitudinally with respect to said second set of said wells.

6. An apparatus for packaging fasteners, said apparatus comprising:

a tray having a plurality of wells, each said well being sized to accommodate a shank of a respective fastener therein; and an adhesive connector between the fastener and the tray for securing the fasteners in said wells, whereby the fasteners are released by exerting torsion on said fasteners.

7. The apparatus of claim 6, further comprising a plurality of bores, each said bore (a) being associated with an entrance of a respective said well, (b) having a bore diameter greater than a well diameter of said well and (c) accommodating a head of the fasteners.

8. The apparatus of claim 6, wherein said tray has a first side opposite to a second side; and wherein said plurality of wells comprises a first set of said wells in said first side and a second set of said wells in said second side.

9. The apparatus of claim 8, wherein said first set of said wells are offset longitudinally with respect to said second set of wells.

10. The apparatus of claim 6, wherein each said well is sized to hold the associated fastener by friction.

11. The apparatus of claim 6, wherein each said well has a well diameter less than a shank diameter of the fastener.

12. The apparatus of claim 6, wherein each said well has a diameter at least as large as a shank diameter of the fastener.

13. The apparatus of claim 6, wherein each said well has a diameter greater than a shank diameter of the fastener.

14. The apparatus of claim 6, wherein said tray is formed from styrofoam.

15. The apparatus of claim 6, wherein said tray is formed from two plastic shells joined to each other.

16. The apparatus of claim 6, further comprising an attachment device which secures the tray to the user.

17. The apparatus of claim 16, wherein said attachment device comprises:

complementary tracks on opposing sidewalls of said tray; and a metal frame with two opposing rails adapted to slidingly engage with said complementary tracks of said tray.

18. The apparatus of claim 17, wherein said attachment device further comprises a strap attached to said metal frame and removably attachable to the user.

19. The apparatus of claim 18, wherein said strap is removably attachable to a wrist of the user.

20. The apparatus of claim 18, wherein said strap is removably attachable to a belt worn by the user.

21. A system for packaging fasteners, said system comprising:

a plurality of fasteners each having a shank with a shank diameter and a head;

a tray having a plurality of openings, each said opening being sized to receive the shank of a respective fastener therein; and an attachment device which secures the tray to a user.

22. The system of claim 21, wherein said tray is formed from material comprising plastic.

23. The system of claim 21, wherein said plurality of openings comprises a first set of said openings in a first side of said tray and a second set of said openings in a second side opposite to said first side.

24. The system of claim 23, wherein said first set of said openings is offset longitudinally with respect to said second set of said openings.

25. An apparatus for packaging fasteners, said apparatus comprising:

a tray having a plurality of openings, each said opening being sized to accommodate a shank of a respective fastener therein; and an adhesive connector between the fastener and the tray for securing the fasteners in said openings, whereby the fasteners are released by exerting torsion on said fasteners.

26. The apparatus of claim 25, further comprising a plurality of bores, each said bore (a) being associated with an entrance of a respective said opening, (b) having a bore diameter greater than an opening diameter of said well and (c) accommodating a head of the fasteners.

27. The apparatus of claim 25, wherein said tray has a first side opposite to a second side; and wherein said plurality of openings comprises a first set of said openings in said first side and a second set of said openings in said second side.

28. The apparatus of claim 27, wherein said first set of said openings is offset longitudinally with respect to said second set of openings.

29. The apparatus of claim 25, wherein each said opening is sized to hold the associated fastener by adhesive.

30. The apparatus of claim 25, wherein each said opening has a diameter greater than a shank diameter of the fastener.

31. The apparatus of claim 25, wherein said tray is formed from two plastic shells joined to each other.

32. The apparatus of claim 25, further comprising an attachment device which secures the tray to a user.

33. The apparatus of claim 32, wherein said attachment device comprises:

complementary tracks on opposing sidewalls of said tray; and a metal frame with two opposing rails adapted to slidingly engage with said complementary tracks of said tray.

34. The apparatus of claim 33, wherein said attachment device further comprises a strap attached to said metal frame and removably attachable to the user.

35. The apparatus of claim 34, wherein said strap is removably attachable to a wrist of the user.

36. The apparatus of claim 34, wherein said strap is removably attachable to a belt worn by the user.

37. An apparatus for packaging fasteners, said apparatus comprising:

a tray having a plurality of openings, each said opening being sized to accommodate a shank of a respective fastener therein; and a connector means between the fastener and the tray for securing the fasteners in said openings, whereby the fasteners are released by exerting torsion on said fasteners.

38. The apparatus of claim 37, further comprising a plurality of bores, each said bore (a) being associated with an entrance of a respective said opening, (b) having a bore diameter greater than an opening diameter of said well and (c) accommodating a head of the fasteners.

39. The apparatus of claim 37, wherein said tray has a first side opposite to a second side; and wherein said plurality of openings comprises a first set of said openings in said first side and a second set of said openings in said second side.

40. The apparatus of claim 39, wherein said first set of said openings is offset longitudinally with respect to said second set of openings.

41. The apparatus of claim 37, wherein each said opening is sized to hold the associated fastener by said connector means.

42. The apparatus of claim 37, wherein each said opening has a diameter greater than a shank diameter of the fastener.

43. The apparatus of claim 37, wherein said tray is formed from two plastic shells joined to each other.

44. The apparatus of claim 37, further comprising an attachment device which secures the tray to a user.

45. The apparatus of claim 44, wherein said attachment device comprises:

complementary tracks on opposing sidewalls of said tray; and a metal frame with two opposing rails adapted to slidingly engage with said complementary tracks of said tray.

46. The apparatus of claim 45, wherein said attachment device further comprises a strap attached to said metal frame and removably attachable to the user.

47. The apparatus of claim 46, wherein said strap is removably attachable to a wrist of the user.

48. The apparatus of claim 46, wherein said strap is removably attachable to a belt worn by the user.

* * * * *